United States Patent [19]

Kamimura et al.

[11] Patent Number: 5,075,731

[45] Date of Patent: Dec. 24, 1991

[54] TRANSFER ROLLER DEVICE

[75] Inventors: Taisuke Kamimura, Kitakatsuragi; Yasutaka Maeda, Ikoma; Tuyoshi Miyamoto, Osaka; Katsuhiro Nagayama; Hideyuki Nishimura, both of Yamatokoriyama; Natsuko Tanaka, Fukuoka, all of Japan

[73] Assignee: Sharp Kabushiki Kaisha, Osaka, Japan

[21] Appl. No.: 668,293

[22] Filed: Mar. 12, 1991

[30] Foreign Application Priority Data

| | | | |
|---|---|---|---|
| Mar. 13, 1990 | [JP] | Japan | 2-62207 |
| Mar. 13, 1990 | [JP] | Japan | 2-62208 |
| Nov. 30, 1990 | [JP] | Japan | 2-340189 |
| Nov. 30, 1990 | [JP] | Japan | 2-340190 |

[51] Int. Cl.[5] ..... G03G 15/16

[52] U.S. Cl. ..... 355/274; 355/271; 355/277; 355/326

[58] Field of Search ..... 355/203, 204, 271, 274, 355/275, 276, 277, 326, 327, 217; 361/214, 221, 222

[56] References Cited

U.S. PATENT DOCUMENTS

| | | | |
|---|---|---|---|
| 3,900,003 | 8/1975 | Sato et al. | 355/327 X |
| 4,588,279 | 5/1986 | Fukuchi et al. | 355/271 |
| 4,796,048 | 1/1989 | Bean | 355/277 |
| 4,825,256 | 4/1989 | Nakai et al. | 355/326 X |
| 4,912,516 | 3/1990 | Kaieda | 355/274 |
| 4,931,839 | 6/1990 | Tompkins et al. | 355/277 |
| 4,935,787 | 6/1990 | Maeda et al. | 355/326 |
| 4,954,846 | 9/1990 | Matsuo et al. | 355/204 X |
| 4,956,676 | 9/1990 | Fukae et al. | 355/271 X |

FOREIGN PATENT DOCUMENTS

| | | |
|---|---|---|
| 59-125765 | 7/1984 | Japan . |
| 1-83288 | 1/1989 | Japan . |

*Primary Examiner*—A. T. Grimley
*Assistant Examiner*—Sandra L. Brase
*Attorney, Agent, or Firm*—David G. Conlin; Robert M. Asher

[57] ABSTRACT

A transfer roller device for transferring onto a copy paper sheet a full color toner image formed on an intermediate transfer belt. A rear-surface electrode roller disposed at the opposite side to a transfer roller with the intermediate transfer belt positioned in between, is divided into a plurality of cylinder members, and at least one of the cylinder members corresponding to the size of a copy paper sheet is separately connected to ground. With the arrangement, occurrence of an excess current through a portion of the intermediate transfer belt carrying no copy paper sheet thereon is eliminated, thereby preventing a filming phenomenon. In another arrangement, a plurality of rear-surface electrode rollers are disposed at respective positions associated with a plurality of respective copying speeds which are set according to copy paper sheets. Thus, a voltage to be applied between the transfer roller and the rear-surface electrode roller is maintained constant regardless of different copying speeds.

12 Claims, 16 Drawing Sheets

TRANSFER ROLLER DEVICE

FIELD OF THE INVENTION

The present invention relates to a transfer roller device for use in electrophotographic apparatus such as full color copying machines.

BACKGROUND OF THE INVENTION

For example, in a full color copying machine such as shown in FIG. 17, a full color copying operation is performed as follows. Scanning is executed by an exposure lamp 102 of an optical system 101 three times with respect to a color original document 103, and light reflected from the color original document 103 in each of the scans is independently transmitted through a predetermined one of three filters having respective three colors of red, green, and blue in a filter device 104, thereby irradiating a photoconductor 105. Thus, the photoconductor 105 is exposed, and three electrostatic latent images are formed on the photoconductor 105. Subsequently, each of the electrostatic latent images obtained through the above three exposures is independently developed by respective color toner which is one of three colored developers of yellow, magenta and cyan, stored in developing devices 106 to 108, and the resulting toner images are successively transferred onto an intermediate transfer belt 109, being overlapped thereon one upon another to form a toner image. Next, the toner image on the intermediate transfer belt 109 is transferred onto a copy paper sheet (not shown), and a color picture image is obtained on the copy paper sheet by fixing the toner image on the copy paper sheet through heat treatment at a fixing device 110.

The above transfer operation of the toner image from the intermediate transfer belt 109 to the copy paper sheet is performed by a back-up roller 111 made of rubber such as insulating silicon rubber, a rear-surface electrode roller 112 of driven type, disposed at a vicinity of the back-up roller 111, and a metal transfer roller 113 disposed confronting the back-up roller 111, with the intermediate transfer belt 109 interposed in between. More concretely, the intermediate transfer belt 109 is supported from its back side by the back-up roller 111 and the rear-surface electrode roller 112, and while supplying a copy paper sheet so as to superpose it on the toner image on the intermediate transfer belt 109, the transfer roller 113 and the back-up roller 111 depress the copy paper sheet onto the intermediate transfer belt 109. Then, under the above condition, as shown in FIG. 18, a transfer voltage is applied between the transfer roller 113 and the rear-surface electrode roller 112 from a power supply 115, thereby transferring the toner image formed on the intermediate transfer belt 109 onto the copy paper sheet 114.

However, the conventional arrangement results in the following problems when transferring the toner image formed on the intermediate transfer belt 109 onto the copy paper sheet 114.

More specifically, in the transfer operation, when the transfer voltage is applied between the transfer roller 113 and the rear-surface electrode roller 112, a current $I_1$ of substantial 50 to 100 $\mu$A flows between the transfer roller 113 and the rear-surface electrode roller 112 in a portion having the intermediate transfer belt 109 and the copy paper sheet 114 interposed therebetween, for example, in the case of applying a transfer voltage of 2 kV, as shown in FIG. 19 (*a*), since there exist a resistance $R_{TX}$ of the intermediate transfer belt 109 and a resistance $R_p$ of the copy paper sheet 114 between the rollers 113 and 112. On the other hand, in a portion between the transfer roller 113 and the rear-surface electrode roller 112, having only the intermediate transfer belt 109 interposed therebetween, that is, having no copy paper sheet 114 interposed therebetween, an excess current $I_2$ of substantial 2 mA flows due to a drop of the total resistance of the circuit caused by the absence of the resistance $R_p$ of the copy paper sheet 114, as shown in FIG. 19 (*b*). For that reason, in the case where there is some toner remaining on the intermediate transfer belt 109 between the transfer roller 113 and the rear-surface electrode roller 112 in a portion having no copy paper sheet 114 interposed therebetween, the toner adheres on the intermediate transfer belt 109 due to heat generated by an excess current flowing through the intermediate transfer belt 109, causing a so-called filming phenomenon, and as a result copy quality is adversely affected.

On the other hand, in the full color copying machine, copy paper sheets 114 of various kinds and sizes, for example, such as sheets for OHP (Over Head Projector), (hereinafter called OHP sheets), A-3 size, or A-4 size copy paper sheets, are used. Therefore, in transfer operation from the intermediate transfer belt 109 to the copy paper sheet 114, depending on the kind and size of the copy paper sheet 114, one of modes, such as OHP mode, A-3 mode or A-4 mode is selected so as to set a travel speed of the intermediate transfer belt 109, that is, a process speed, to 60 mm/s, 115 mm/s, or 184 mm/s respectively.

However, since the process speed in transfer operation is different depending on each mode to be set according to the kind and size of the copy paper sheet 114, an optimum value of the transfer voltage is different in each of the modes. Therefore, a different transfer voltage should be set for each of the modes in order to obtain a desirable transfer operation, and for that reason it is necessary to install expensive transformers for the respective modes, resulting in a high manufacturing cost.

SUMMARY OF THE INVENTION

It is an object of the present invention to provide a transfer roller device which is capable of eliminating a filming phenomenon, which is caused by residual toner on an image forming medium, heated by an excess current.

It is another object of the present invention to provide a transfer roller device wherein a transfer voltage is set to an optimum constant value for each of modes without the necessity of changing the transfer voltage depending on each mode appropriate to the size of copy paper sheets to be used.

In order to achieve the above objects, in a transfer roller device in which the transfer roller is disposed at the front surface of the belt-like image forming medium, and at the rear surface of the belt-like image forming medium, are installed the back-up roller confronting the transfer roller and the rear-surface electrode roller being spaced at a predetermined interval to the back-up roller and in contact with the image forming medium, whereby a copy paper sheet fed between the transfer roller and the image forming medium is depressed onto the image forming medium by the transfer roller and the back-up roller while applying a transfer voltage between the rear-surface electrode roller and the transfer roller such that an image formed by developers on the front surface of the image forming medium is transferred onto the copy paper sheet, the present invention provides the following arrangement:

A copy paper sheet is transported with its transport reference position coinciding with a reference position of the rear-surface electrode roller, and the rear-surface electrode roller is divided into a plurality of cylinder members at positions, each corresponding to a length from the transport reference position of a copy paper sheet of each size in a direction perpendicular to the transport direction, while keeping the coincidence between the reference position of the rear-surface electrode roller and the transport reference position of the copy paper sheet. And among the cylinder members, at least one of those members forming a portion corresponding to a length of a copy paper sheet to be used in the direction perpendicular to the transport direction is connected to ground.

With the above arrangement, the rear-surface electrode roller is connected to ground only at a portion corresponding to each size of copy paper sheets to be used, and therefore, no voltage is applied to a portion of the image forming medium having no copy paper sheet interposed between the transfer roller and the rear-surface electrode roller, whereas a voltage is applied only to a portion of the image forming medium having a copy paper sheet interposed between the transfer roller and the rear-surface electrode roller. For that reason, no current flows at the portion of the image forming medium having no copy paper sheet interposed therebetween, thereby preventing a generation of heat due to an excess current. As a result, even if there is some toner remaining on the portion of the image forming medium having no copy paper sheet interposed therebetween, the toner on the image forming medium does not cause a filming phenomenon.

Furthermore, in order to solve the aforementioned problems, a transfer roller device of the present invention has the following arrangement.

The rear-surface electrode rollers as many in number as there are a plurality of modes for providing different travel speeds of an image forming medium, are installed, and those rear-surface electrode rollers are disposed, each having a different distance from the contact point of the transfer roller and the back-up roller according to a travel speed of the image forming medium of respective mode, and one of the rear-surface electrode rollers corresponding to a specified mode is connected to ground.

With the above arrangement, the rear-surface electrode rollers installed as many as a plurality of modes for providing different travel speeds of the image forming medium, are disposed, each having a different distance from the contact point of the transfer roller and the back-up roller according to a travel speed of the image forming medium of respective mode, and one of the rear-surface electrode rollers corresponding to a specified mode is connected to ground such that a resistance value of the image forming medium from the contact point of the transfer roller and the back-up roller to the rear-surface electrode roller can be changed according to a travel speed of the image forming medium in each mode, that is, a process speed in transfer operation in each mode. As a result, the necessity of separately setting for each of the modes a transfer voltage to be applied between the transfer roller and the rear-surface electrode roller is eliminated, and therefore the necessity of installing a plurality of expensive transformers for setting a plurality of respective transfer voltages is eliminated. Thus, the transfer voltage is set to an optimum constant value for each of the modes, and high-quality copies can be obtained at low cost.

For a fuller understanding of the nature and advantages of the invention, reference should be made to the ensuing detailed description taken in conjunction with the accompanying drawings.

BRIEF DESCRIPTION OF THE DRAWINGS

FIG. 1 (*a*) is a front view illustrating a rear-surface electrode roller composed of a plurality of cylinder members.

FIG. 1 (*b*) is a side view illustrating the rear-surface electrode roller.

FIG. 2 is a schematic perspective view illustrating an arrangement at a vicinity of the rear-surface electrode roller in a transfer roller device.

FIG. 3 is a schematic perspective view illustrating an arrangement for connecting the rear-surface electrode roller to ground.

FIG. 4 is a schematic view of the transfer roller device.

FIG. 5 is an explanatory view illustrating an arrangement at a vicinity of a paper cassette mounting section in a full color copying machine.

FIG. 6 is a perspective view illustrating a paper size detection section of the paper cassette of FIG. 5.

FIG. 7 is a schematic elevational view of the full color copying machine.

FIG. 8 is a block diagram showing an arrangement of a cylinder member switching device installed in the transfer roller device.

FIG. 9 (*a*) is a diagram showing an equivalent circuit between the transfer roller and the rear-surface electrode roller at a portion having a copy paper sheet interposed therebetween, in transfer operation.

FIG. 9 (*b*) is a diagram showing an equivalent circuit between the transfer roller and the rear-surface electrode roller at a portion having no copy paper sheet interposed therebetween, in transfer operation.

FIG. 10 is an explanatory view of current density in transfer operation in the case where a cylinder member of the rear-surface electrode roller is connected to ground.

FIG. 11 is a schematic view of a transfer roller device.

FIG. 12 is a schematic view illustrating conditions of the transfer roller device in transfer operation.

FIG. 13 is a schematic perspective view illustrating an arrangement for connecting the rear-surface electrode roller to ground.

FIG. 14 is a perspective view illustrating a paper size detection section of a paper cassette.

FIG. 15 is a schematic elevational view of a full color copying machine.

FIG. 16 is a block diagram showing an arrangement of the rear-surface electrode roller switching device installed in the transfer roller device.

FIG. 17 is a schematic elevational view of a full color copying machine.

FIG. 18 is a schematic view of a transfer roller device.

FIG. 19 (*a*) is a diagram showing an equivalent circuit between the transfer roller and the rear-surface electrode roller at a portion having a copy paper sheet interposed therebetween, in transfer operation.

FIG. 19 (*b*) is a diagram showing an equivalent circuit between the transfer roller and the rear-surface electrode roller at a portion having no copy paper sheet interposed therebetween, in transfer operation.

DETAILED DESCRIPTION OF THE EMBODIMENTS

The following description will discuss one embodiment of the present invention referring to FIGS. 1 to 10. In this embodiment, a transfer roller device of the present invention is applied to a full color copying machine.

Figure 7:
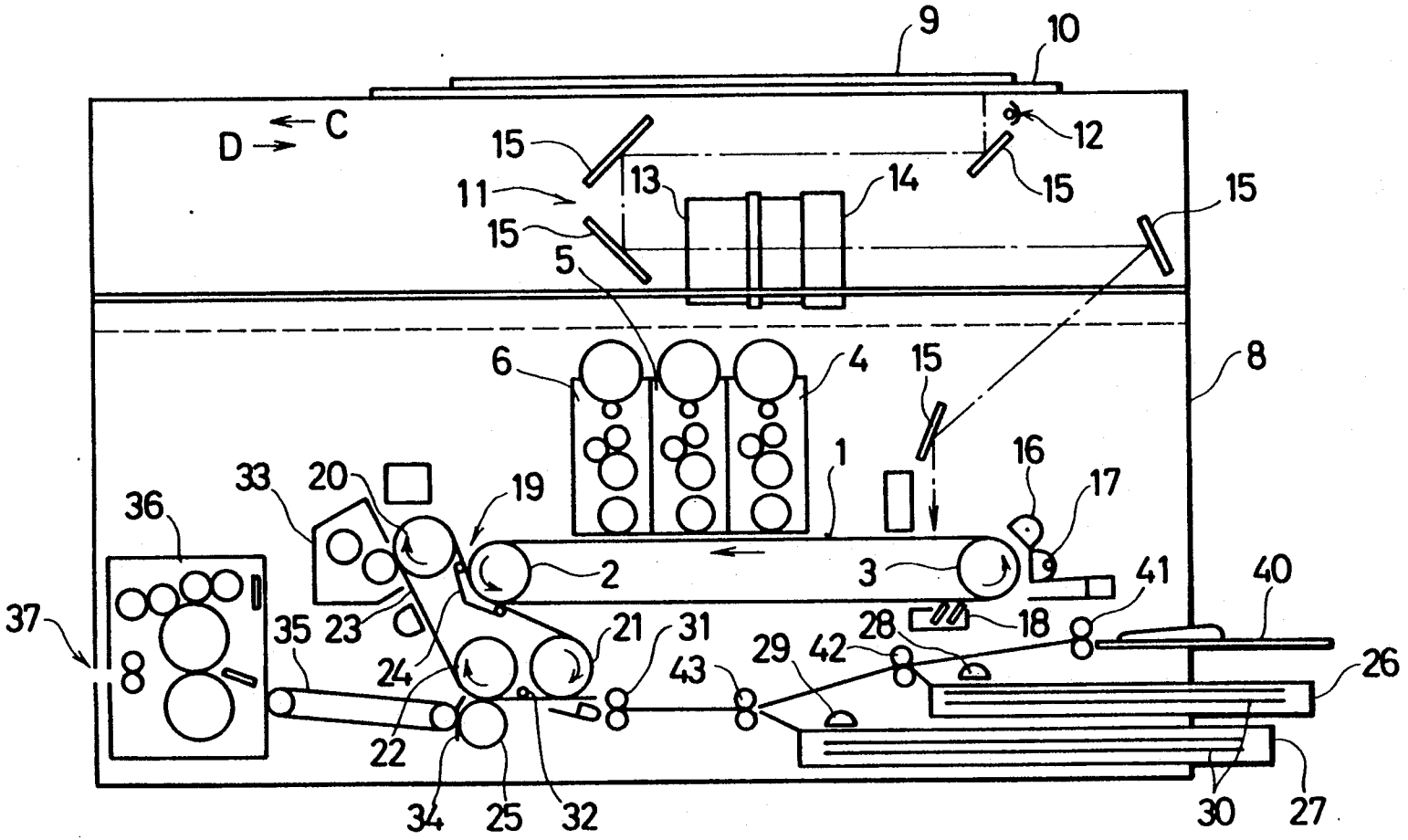

As shown in FIG. 7, in the full color copying machine, a document platen 10, on which an original document 9 to be copied is placed, is disposed on the upper surface of a machine housing 8. Below the document platen 10, is disposed an optical system 11 for forming electrostatic latent images on a photoconductor belt 1, which will be described later, by scanning the original document 9. The optical system 11 includes a copy lamp 12, a plurality of mirrors 15, a lens 13 and a filter assembly 14 having blue, red and green filters.

Below the optical system 11, is disposed a photoconductor belt 1 made of organic photoconductor (OPC photoconductor). The photoconductor belt 1 is passed around a drive roller 2 and a driven roller 3, both of which are disposed in parallel to each other with a predetermined interval. Around the photoconductor belt 1 are disposed a charger 16, developing devices 4, 5 and 6, a cleaning device 18 and an eraser lamp 17, all of which confront the photoconductor belt 1. The developing devices 4, 5 and 6 accommodate respective developers in yellow, magenta and cyan.

An intermediate transfer device 19 is disposed in a vicinity of the drive roller 2. The intermediate transfer device 19 includes a drive roller 20, a driven roller 21, a transfer roller 25, an intermediate transfer belt 23 as an image forming medium, a back-up roller 22 as a driven roller for supporting the transfer roller 25 from the rear-surface side of the intermediate transfer belt 23 in transfer operation, an intermediate transfer charger 24, a rear-surface electrode roller 32, a cleaner 33, and a separation plate 34.

The intermediate transfer belt 23 is passed around the drive roller 20, the driven roller 21 and the back-up roller 22, and a portion of the photoconductor belt 1 at the drive roller 2 side is depressed onto a portion of the intermediate transfer belt 23 between the drive roller 20 and the driven roller 21.

The intermediate transfer charger 24 is disposed at the rear-surface side of the intermediate transfer belt 23 where the portion of the photoconductor belt 1 at the drive roller 2 side is depressed thereto, such that a monochromatic toner image formed on the photoconductive belt 1 is transferred onto the intermediate transfer belt 23. The cleaner 33 is disposed in a vicinity of the drive roller 20 so as to remove residual toner from the intermediate transfer belt 23. The separation plate 34 is disposed in a vicinity of the back-up roller 22 and the transfer roller 25 so as to separate a copy paper sheet 30 from the intermediate transfer belt 23.

Figure 4:
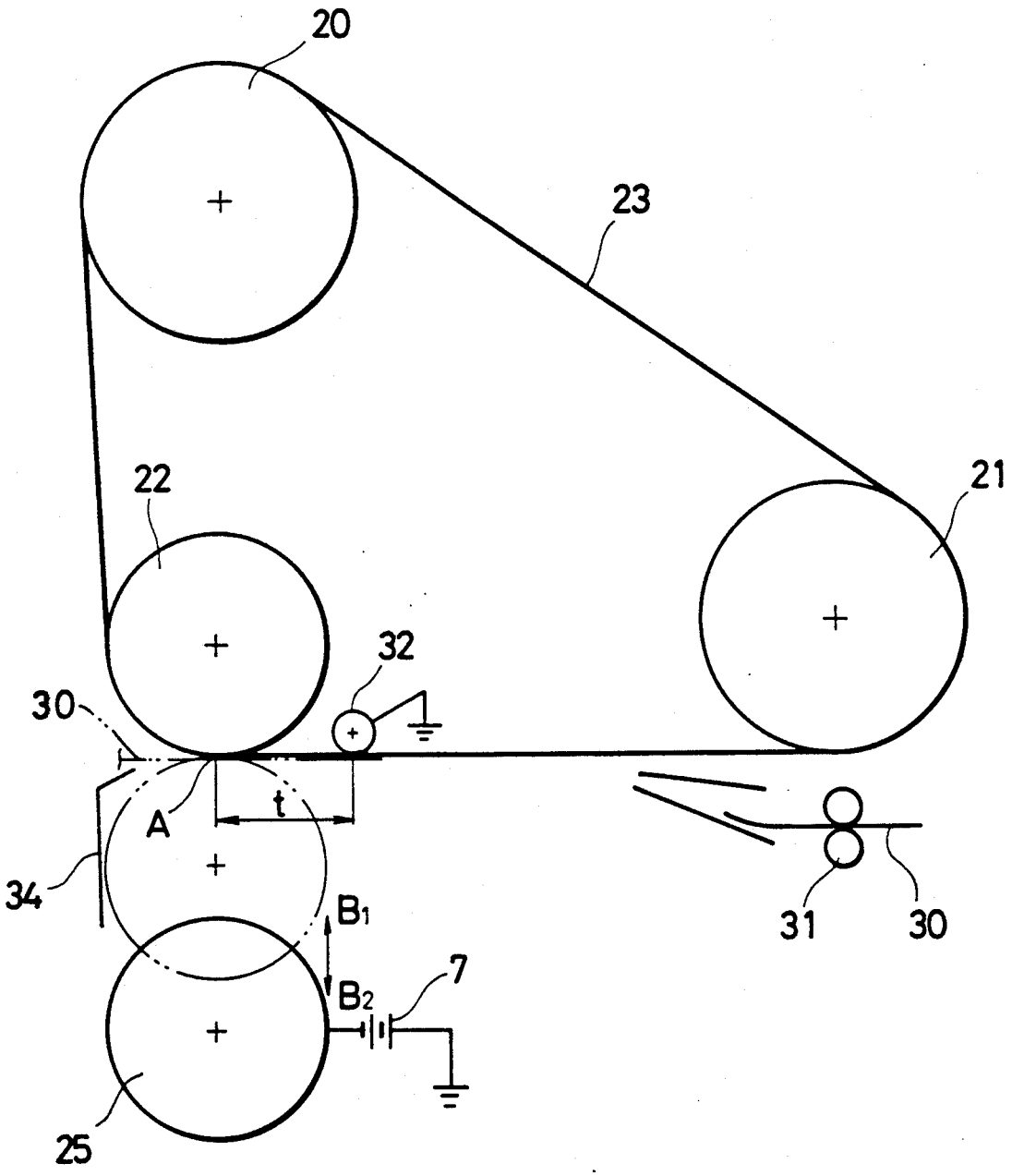

As shown in FIG. 4, the transfer roller 25 is disposed below the back-up roller 22, and permitted to move in directions indicated by arrows $B_1$–$B_2$. When moved toward $B_1$, the transfer roller 25 comes into contact with the back-up roller 22 at a contact point A, with the copy paper sheet 30, which will be described later, and the intermediate transfer belt 23 being interposed in between. The transfer roller 25 is made up of a conductive material such as metal, and a transfer voltage is applied thereto by a power supply 7.

The rear-surface electrode roller 32 is disposed between the back-up roller 22 and the driven roller 21, while being kept in sliding contact with the rear surface of the intermediate transfer belt 23, and more specifically located at a position away from the contact point A of the back-up roller 22 and the transfer roller 25 with a distance t (=substantial 10 to 18 mm) toward the driven roller 21.

Figure 1:
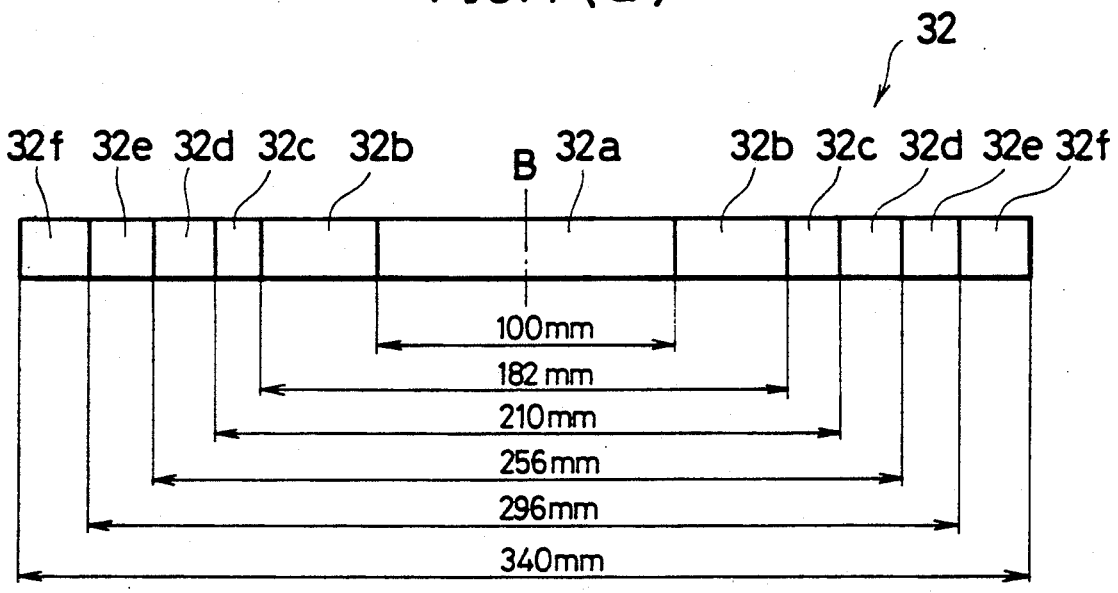
FIGS. 1 to 10 show one embodiment of the present invention.
Figure 1:
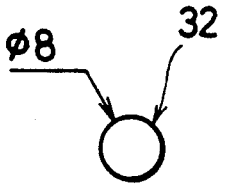
Figure 2:
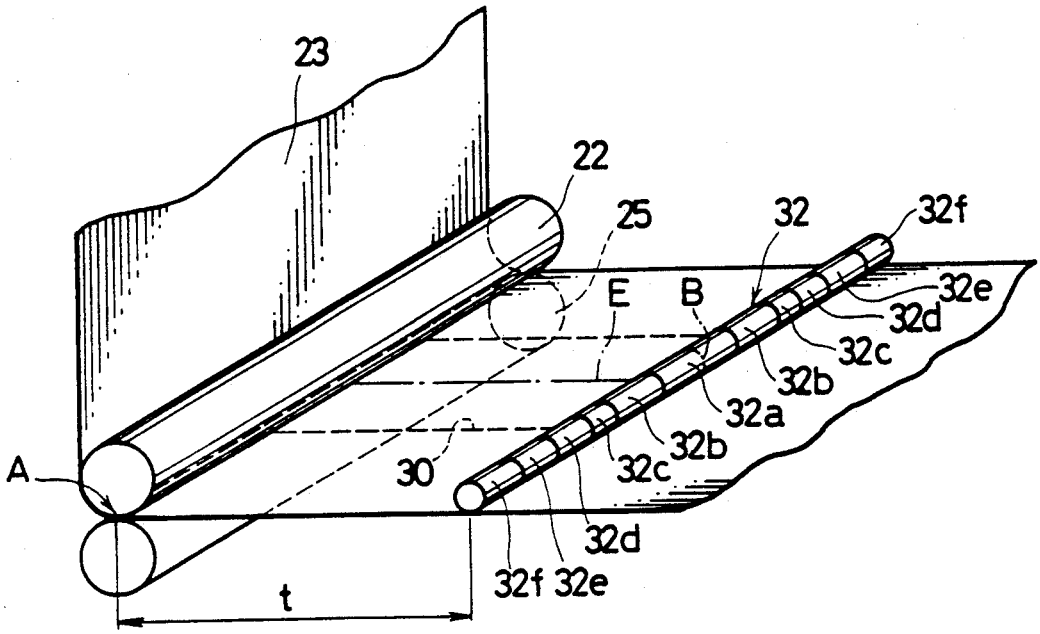
Figure 3:
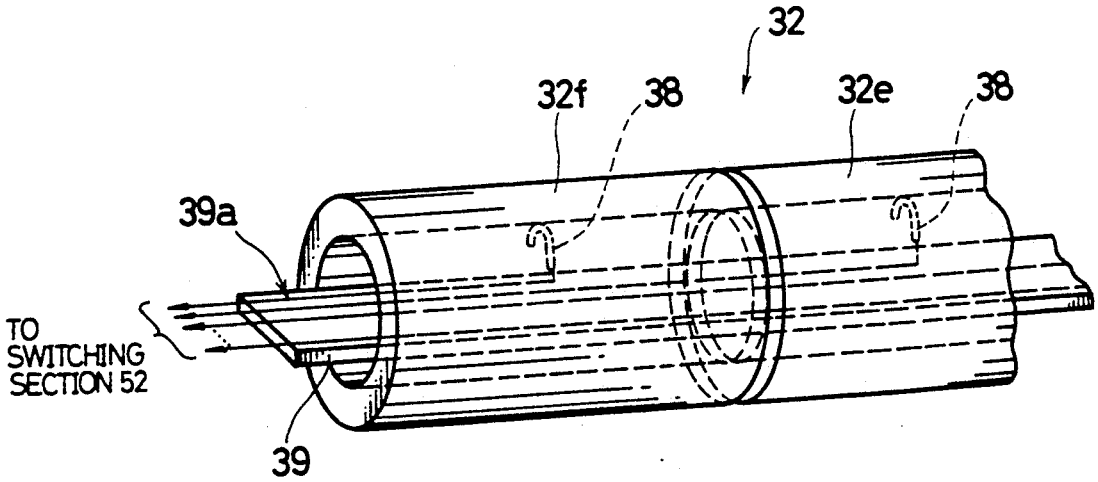

Furthermore, as illustrated in FIGS. 1 (*a*) and (*b*) as well as FIG. 2, the rear-surface electrode roller 32 is made up of, for example, stainless steel with a diameter of substantial 8 mm and a length covering a total width of the intermediate transfer belt 23, and in the present embodiment, divided into eleven cylinder members 32*a* to 32*f* by a plurality of planes perpendicular to a center axis thereof. The cylinder member 32*a* and the paired axis length respectively, are symmetrically disposed to the right and to the left, with the cylinder member 32*a* positioned in the center. The cylinder member 32*a* in the center has an axis length of 100 mm, and the cylinder members 32*b* to 32*f* positioned outward therefrom have their respective axis lengths of 41 mm, 14 mm, 23 mm, 20 mm, and 22 mm, thereby composing the rear-surface electrode roller 32 with a total length of 340 mm. More specifically, the rear-surface electrode roller 32 is installed so that a center of the cylinder member 32*a* disposed in the middle, namely a reference position B, may coincide with a center of the copy paper sheet 30, namely a transport reference position E. Thus, the cylinder members 32*a* to 32*f* are arranged in such a manner that a length of the cylinder member 32*a*, or that of the cylinder member 32*a* and specified pair or pairs of the cylinder members 32*b* to 32*e* (except the paired cylinder members 32*f*) laterally arrayed is allowed to coincide with a length of a copy paper sheet 30 of respective size, which is shown in Table 1 later, in a direction perpendicular to the transport direction thereof, namely a width of a copy paper sheet 30 of respective size with respect to the transport direction thereof. Further, among cylinder members 32*a* to 32*e*, at least one of those members forming a portion corresponding to a width of a copy paper sheet 30 with respect to the transport direction thereof is connected to ground. An arrangement for connecting the rear-surface electrode roller 32 to ground is illustrated in FIG. 3, and described as follows. Inside the rear-surface electrode roller 32 are individually disposed sliding conductors 38, which are in contact with respective inner surfaces of the cylinder members 32*a* to 32*e*. Those sliding conductors 38 are connected to a wiring substrate 39 installed inside the rear-surface electrode roller 32, and further the wiring substrate 39 is connected to a switching section 52 of a cylinder member switching device 48 for connecting wires 39*a* on the wiring substrate 39 to ground, which will be described later.

Figure 5:
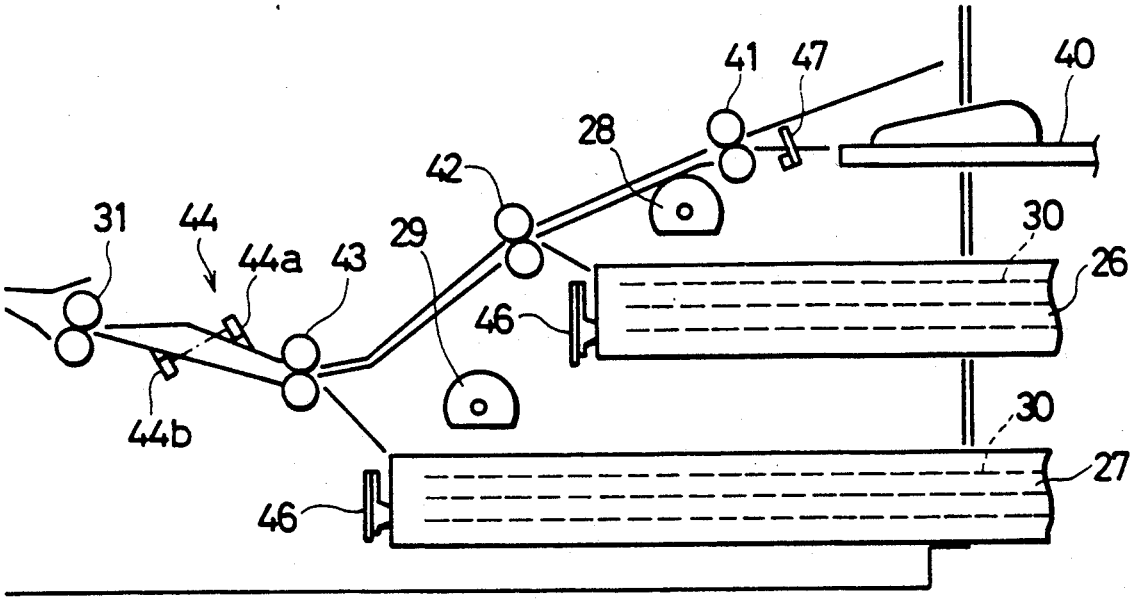

As illustrated in FIG. 5, at the paper feeding side with respect to the intermediate transfer device 19 of FIG. 7, are inserted one above the other paper feed cassettes 26, 27 accommodating copy paper sheets 30, and above the paper feed cassette 26 is disposed a manual paper feed tray 40. In the present embodiment, paper feeding operation of copy paper sheets 30 except post cards and OHP sheets among the types of copy paper sheets 30 shown in Table 1, is available by the use of the paper feed cassettes 26, 27, whereas paper feeding operation of OHP sheets and post cards is available by the use of the manual paper feed tray 40. Between the intermediate transfer device 19, and each of the paper cassettes 26, 27 and the manual paper feed tray 40 are disposed paper feed rollers 28, 29, 41, transport rollers 42, 43 and a timing roller 31 for feeding each copy paper sheet 30 at a predetermined timing. Between the manual paper feed tray 40 and the paper feed roller 41 is installed a manual paper feed detection switch 47 for detecting a copy paper sheet manually fed from the manual paper feed tray 40, and between the transport roller 43 and the timing roller 31 is installed an OHP sensor 44 composed of a light emitting element **44*a* and a light receiving element 44*b*, which detects whether a copy paper sheet 30** being transported is an OHP sheet or not.

Figure 6:
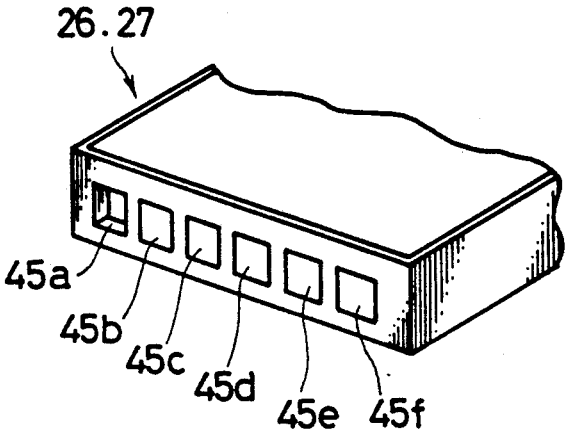

As illustrated in FIG. 6, on each front end surface of the paper cassettes 26, 27 to be inserted into the copying machine housing are disposed paper size detection sections **45*a* to 45*f* for indicating the size of the copy paper sheets 30 accommodated in the paper cassette 26 or 27. These paper size detection sections 45*a* to 45*f* are designed to be selectively recessed, for example, as shown by the paper size detection section 45*a*. On the other hand, as illustrated in FIG. 5, at areas in the copying machine housing, which have operative relationship with the paper size detection sections 45*a* to 45*f*, are disposed paper size detection switch sections 46, each having detection switches (not shown) which match respective paper size detection sections 45*a* to 45*f*. Accordingly, when the paper cassette 26 or 27 is inserted into the copying machine housing, a specified one of the paper size detection sections 45*a* to 45*f* of the paper cassette 26 or 27 is recessed, and one of the detection switches of the paper size detection switch section 46, matching the recessed section, is turned on by the recessed section, thereby permitting the detection of the size of the copy paper sheets 30 accommodated in the paper cassette 26 or 27. Additionally, relationship of the sizes of the copy paper sheets 30 accommodated in the paper cassette 26 or 27 and the recessed sections of the paper size detection sections 45*a* to 45*f*** is shown in Table 1.

Moreover, a transport belt 35, a fixing device 36 and a paper discharge portion 37 are disposed at the paper discharging side with respect to the intermediate transfer device 19.

Figure 8:
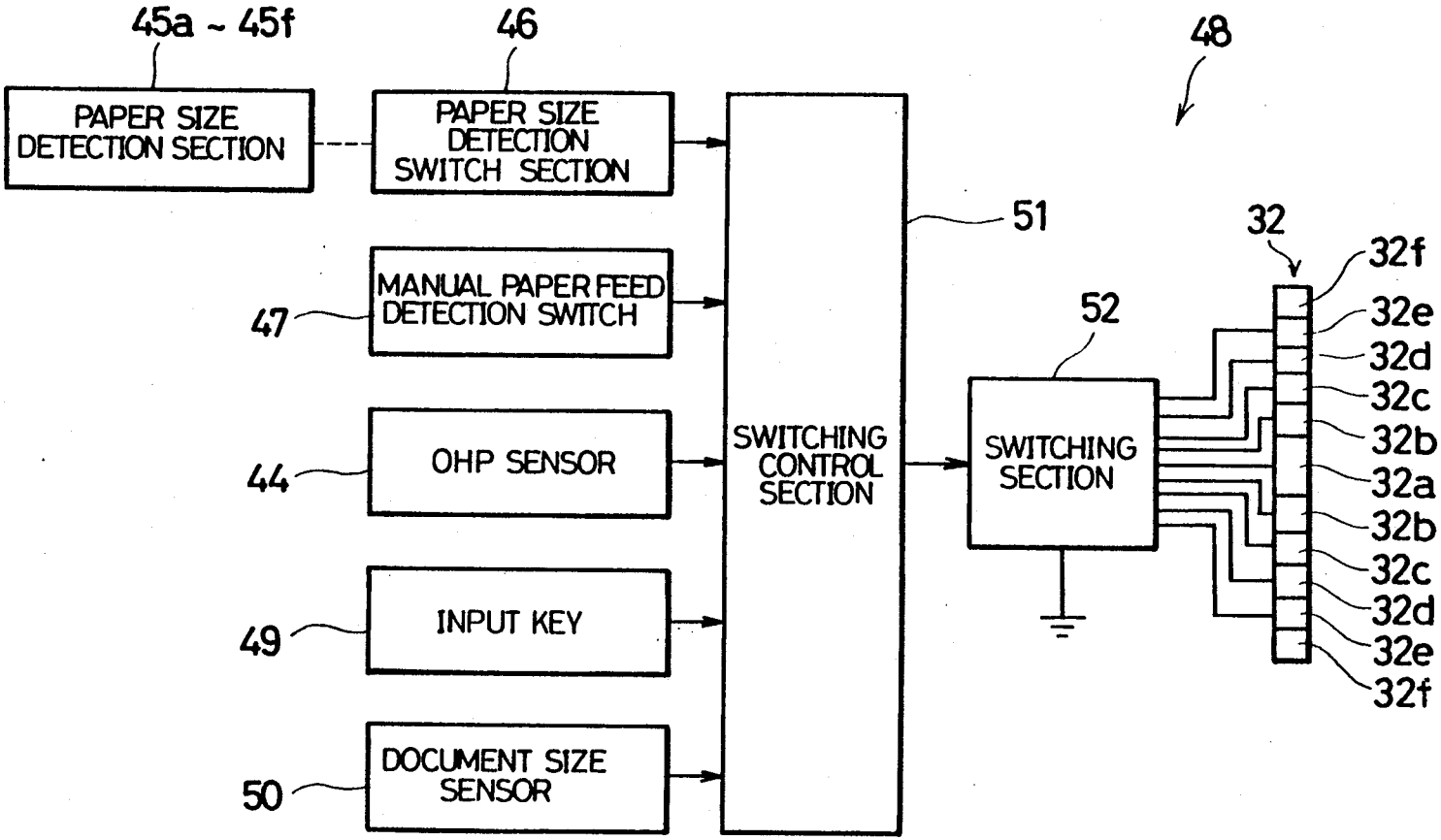

Furthermore, the present transfer roller device is provided with a cylinder member switching device 48 shown in FIG. 8. The cylinder member switching device 48 includes the above-mentioned paper size detection sections **45*a* to 45*f*, paper size detection switch sections 46, manual paper feed detection switch 47 and OHP sensor 44, and further includes an input key 49 for selecting a cassette to be used from the paper cassettes 26, 27, a document size sensor 50 for detecting the size of the original document 9 placed on the document platen 10, which is disposed below the document platen 10, a switching control section 51 as switching control means having a microcomputer, and a switching section 52 as switching means for selectively connecting the cylinder members 32*a* to 32*e* of the rear-surface electrode roller 32 to ground while being controlled by the switching control section 51. The switching section 52 can be constituted of known devices such as electric devices, for example, relays or the like having contact points, or electronic circuits using switching elements therein. The paper size detection sections 45*a* to 45*f*, the paper size detection switch sections 46, the manual paper feed detection switch 47, the OHP sensor 44, the input key 49, and the document size sensor 50** constitute paper size detection means.

The switching control section 51 controls the switching section 52 so that at least one of the cylinder members **32*a* to 32*e* of the rear-surface electrode roller 32, which corresponds to the width of a copy paper sheet 30 to be used with respect to the transport direction may be connected to ground, as is classified in Table 1. The copy paper sheet 30 for which the above control operation is provided, is selected in accordance with the following order of preference: a post card or an OHP sheet is selected by an output of the OHP sensor 44 upon the detection of a manual copy paper sheet supply with the manual paper feed detection switch 47 being switched on; a copy paper sheet 30 accommodated in the paper cassette 26 or 27, which is specified by the input key 49, is selected; a copy paper sheet 30 accommodated in the paper cassette 26 or 27 is selected when it is detected that a copy paper sheet of a specified size is accommodated either in the paper sheet cassette 26 or 27 based on an output of the document size sensor 50 and an output of the paper size detection switch section 46. Additionally, in Table 1 "Paper Size" suffixed with "R" indicates the longitudinal feeding operation having the longer side of a copy paper sheet 30 as its transport direction; without "R", the lateral feeding operation having the shorter side of a copy paper 30** as its transport direction.

TABLE 1

| Paper Size | Recessed Sec. of Paper Size Detect. Sec. | OHP Sensor ON/OFF | Cylinder Members to Ground |
|---|---|---|---|
| Post Card | — | OFF | 32a |
| OHP$^R$ | — | ON | 32a to 32c |
| B5 | 45a | — | 32a to 32d |
| B5$^R$ | 45b | — | 32a to 32b |
| A4 | 45c | — | 32a to 32e |
| A4$^R$ | 45d | — | 32a to 32c |
| B4 | 45e | — | 32a to 32d |
| A3 | 45f | — | 32a to 32e |

With the above arrangement, copying processes of the full color copying machine are performed as follows:

The copy lamp 12 and the mirrors 15 in the optical system 11 of FIG. 7 move back and forth in the directions of arrows C and D below the document platen 10 so that an original document 9 may be scanned. Light emitted from the copy lamp 12 is applied to and reflected from the document 9. As shown by an alternate long and short dash line in FIG. 7, the reflected light reaches the filter assembly 14 via the mirrors 15 and lens 13, where only a part of the reflected light, for example, only a blue light ray is transmitted, and the transmitted light ray is directed onto the front surface of the photoconductor belt 1 which is uniformly charged by the charger 16, thereby forming an electrostatic latent image with respect to yellow on the photoconductor belt 1. The electrostatic latent image is developed in the developing device 4 by adsorbing charged yellow toner, and the resulting yellow toner image is transported by the movement of the photoconductor belt 1 and transferred onto the intermediate transfer belt 23 by the intermediate transfer charger 24 in the intermediate transfer device 19. The photoconductor belt 1 is successively moved, and after yellow toner remaining on its front surface having been removed therefrom by a blade in the cleaning device 18, is electrostatically eliminated by the eraser lamp 17. Successively, the same operations as the above are repeated with respect to developers of cyan and magenta, and toner images of respective colors obtained through the sequence of operations are transferred onto the intermediate transfer belt 23 and overlapped one upon another. Thus, a resulting full color toner image is formed on the intermediate transfer belt 23.

On the other hand, copy paper sheets 30 accommodated in the paper cassette 26 or 27 are fed sheet by sheet to the timing roller 31 by the paper feed roller 28 or 29. The timing roller 31 transports each copy paper sheet 30 to a space between the intermediate transfer belt 23 and the transfer roller 25 in synchronism with the intermediate transfer belt 23. The copy paper sheet 30, after the color toner image formed on the intermediate transfer belt 23 has been transferred thereon, is separated from the intermediate transfer belt 23 by the separation plate 34. The resulting copy paper sheet 30 with the color toner image transferred thereon is transported by the transport belt 35 to the fixing device 36, where the copy paper sheet 30 is subjected to heat and pressure for the fixing. Thereafter, the copy paper sheet 30 is discharged from the paper discharge portion 37.

The transfer operation of the full color toner image from the intermediate transfer belt 23 onto the copy paper sheet 30 is performed by connecting to ground at least one of the cylinder members 32*a* to 32*e* of the rear-surface electrode roller 32 which is specified according to the size of the copy paper sheet 30 to be used among the sizes of post card, OHP$^R$, B5, B5$^R$, A4, A4$^R$, and B4, and thus applying a transfer voltage from the power supply 7 between the transfer roller 25 and the cylinder members 32*a* to 32*e* connected to ground. This transfer operation is performed under conditions as illustrated in FIG. 4, where the copy paper sheet 30 is depressed onto the intermediate transfer belt 23 at a contact point A by the back-up roller 22 and the transfer roller 25 which has been driven and advanced in a direction of an arrow $B_1$. Grounding of the specified cylinder members 32*a* to 32*e* is automatically performed by permitting the switching control section 51 to control the switching operation of the switching section 52 based on the inputs from the paper size detection switch section 46, manual paper feed detection switch 47, OHP sensor 44, input key 49 and document size sensor 50, as is aforementioned.

Figure 9:
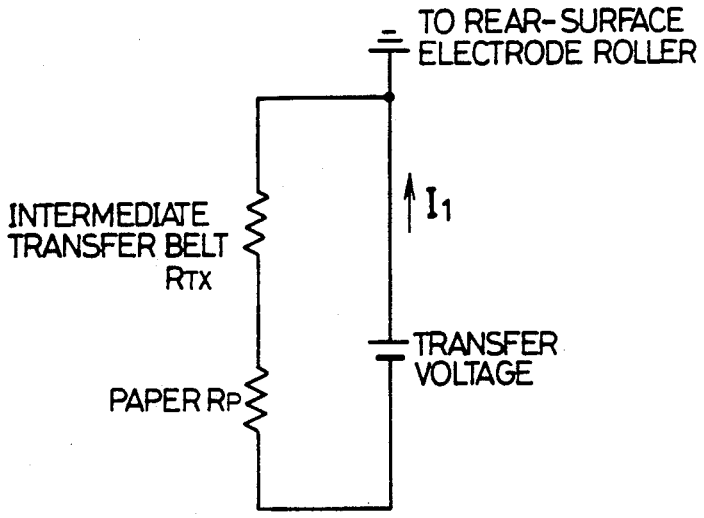
Figure 9:
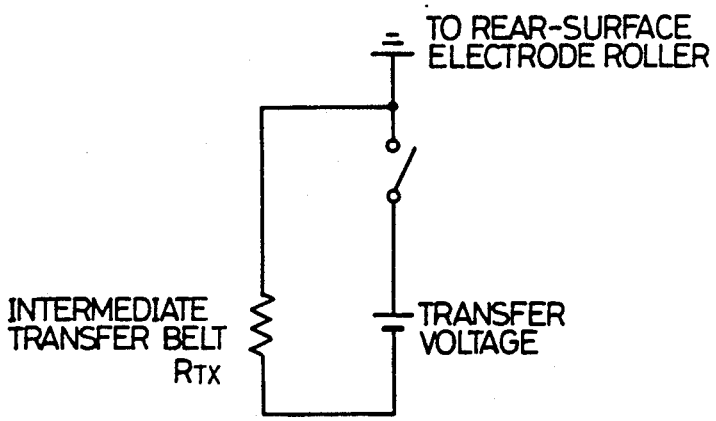
Figure 10:
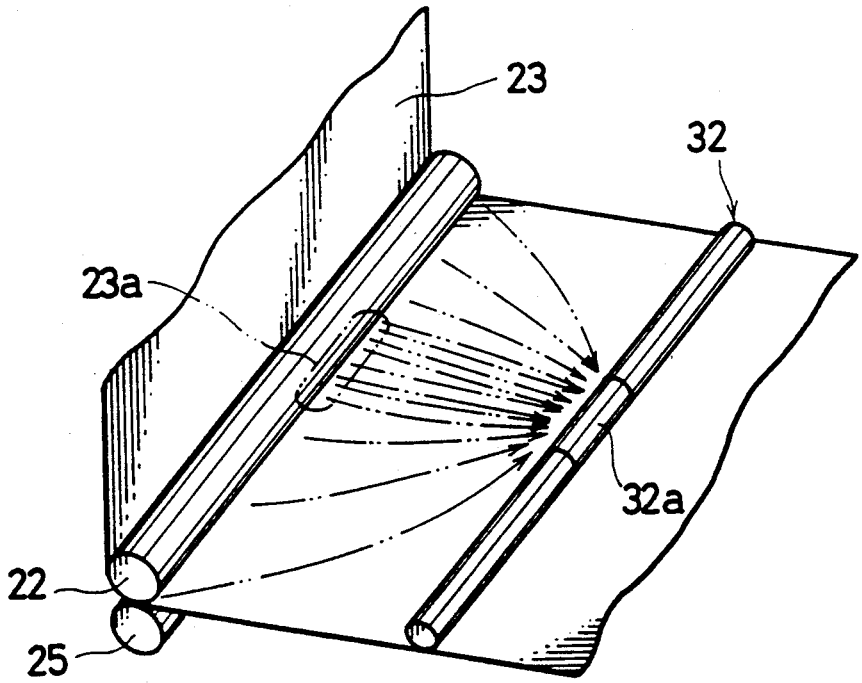
Figure 19:
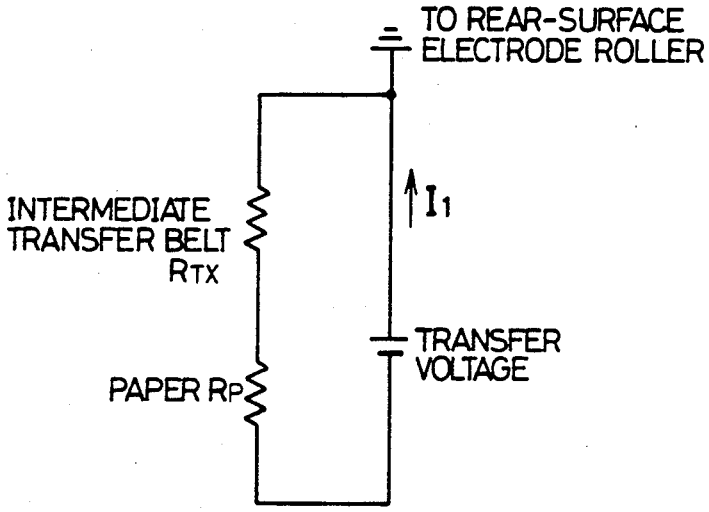
FIG. 19 (a) PRIOR ART
Figure 19:
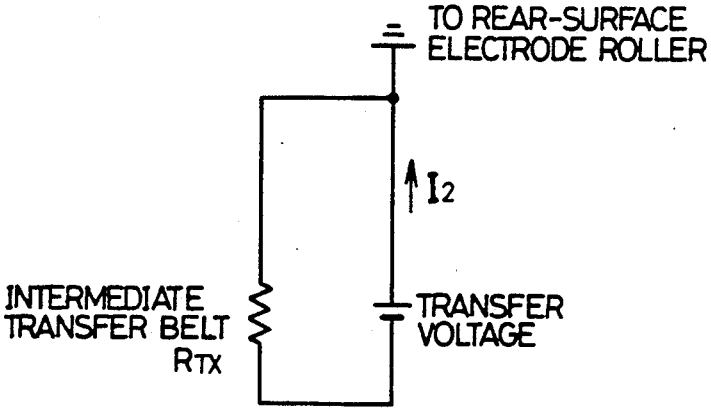
FIG. 19 (b) PRIOR ART

When a transfer voltage is applied between the transfer roller 25 and the rear-surface electrode roller 32 in the transfer operation, a current $I_1$ of substantial 50 to 100 $\mu$A flows between the transfer roller 25 and the rear-surface electrode roller 32 in a portion having the intermediate transfer belt 23 and the copy paper sheet 30 interposed therebetween, for example, in the case of applying a transfer voltage of 2 kV, as shown in FIG. 9 (*a*), since there exist a resistance $R_{TX}$ of the intermediate transfer belt 23 and a resistance $R_p$ of the copy paper sheet 30 between the rollers 25 and 32. This case is the same as was shown in the foregoing FIG. 19 (*a*). On the other hand, in a portion having only the intermediate transfer belt 23 interposed between the transfer roller 25 and the rear-surface electrode roller 32, that is, having nc copy paper sheet 30 interposed therebetween, no transfer voltage is applied and therefore no current flows through the intermediate transfer belt 23 interposed between the rollers 25 and 32, as shown in FIG. 9 (*b*), since those of the cylinder members 32*a* to 32*e* corresponding to this portion are not connected to ground. As illustrated in FIG. 10, for example, in the case of using a post card as the copy paper sheet 30, current density becomes higher in a portion 23*a* of the intermediate transfer belt 23, which corresponds to the cylinder member 32*a* connected to ground. On the other hand, occurrence of an excess current is avoidable in a portion of the intermediate transfer belt 23 without the post card to confront, and therefore a filming phenomenon of toner is preventable even if there is toner adhering on the portion of the intermediate transfer belt 23 without the post card to confront.

The following description will discuss another embodiment of the present invention referring to FIGS. 11 to 16. Additionally, those of the members having the same functions and described in the first embodiment are indicated by the same reference numerals and the description thereof is omitted. In this embodiment, a transfer roller device of the present invention is applied to a full color copying machine, and only OHP sheets, A4 copy paper sheets and A3 copy paper sheets are used as its copy paper sheets.

Figure 15:
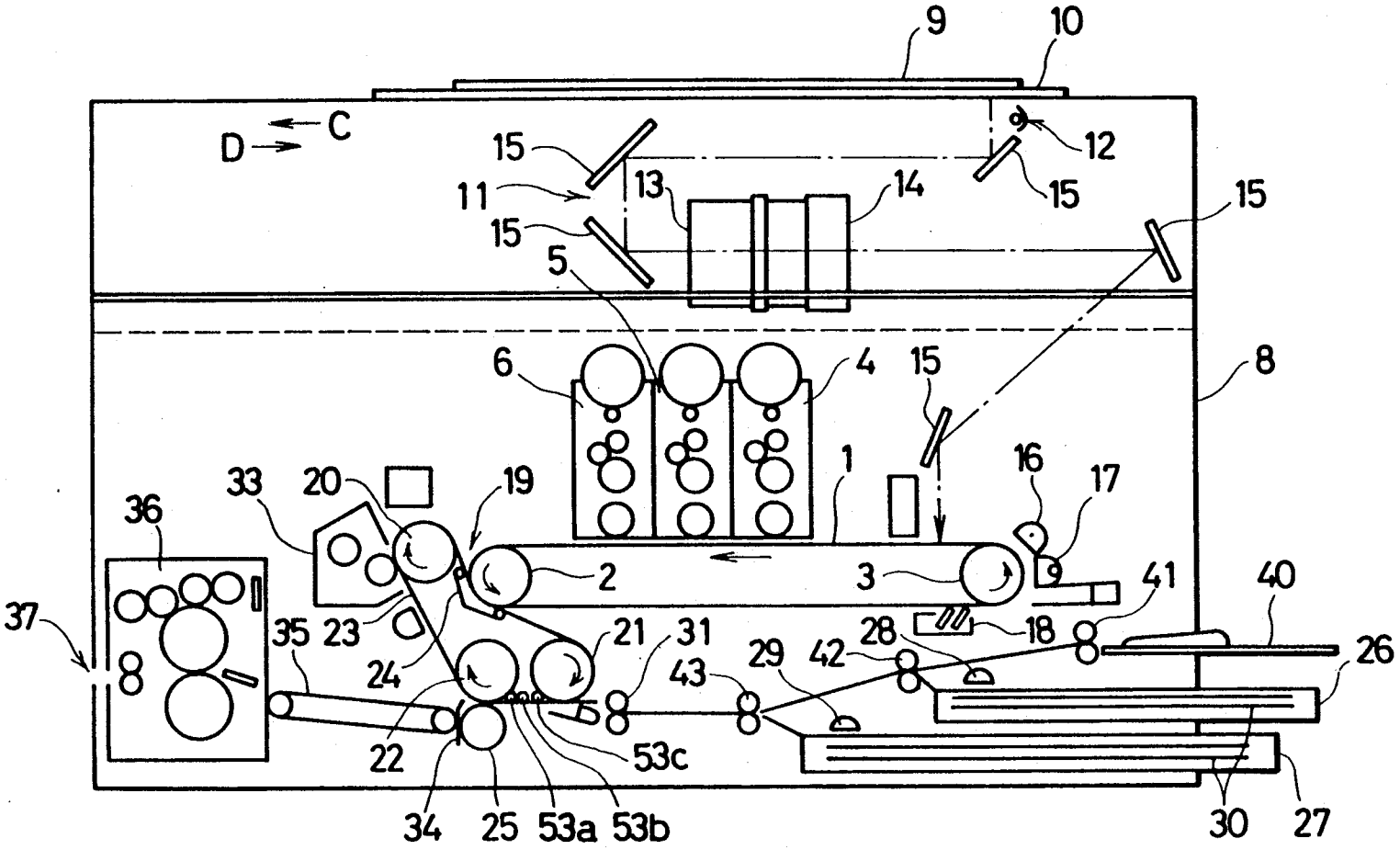

As illustrated in FIG. 15, the intermediate transfer device 19 is disposed in a vicinity of the drive roller 2. The intermediate transfer device 19 includes the drive roller 20, the driven roller 21, the back-up roller 22, the intermediate transfer belt 23, the intermediate transfer charger 24, the transfer roller 25, rear-surface electrode rollers 53*a*, 53*b*, 53*c*, the cleaner 33 and the separation plate 34.

Figure 11:
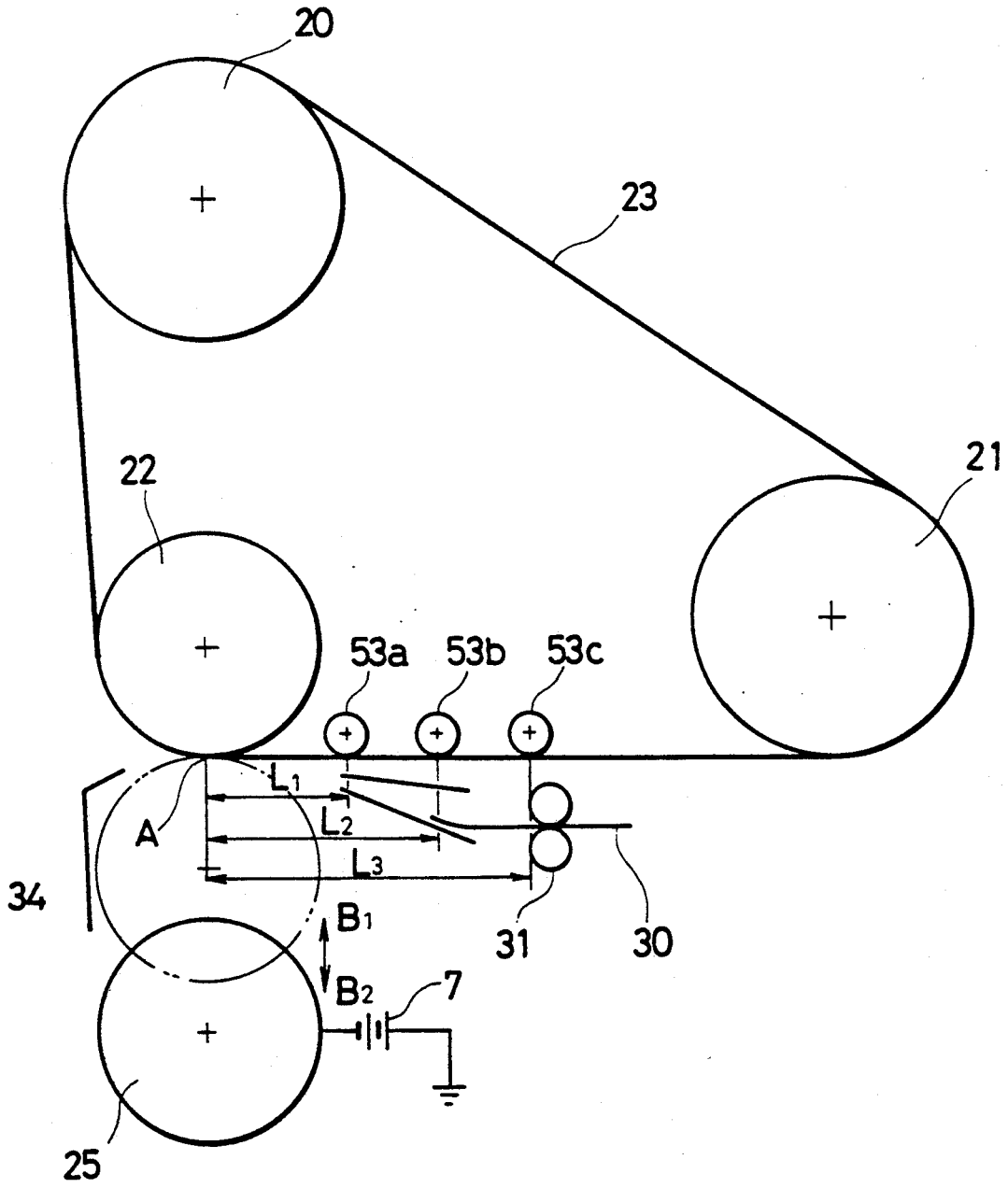
FIGS. 11 to 16 show another embodiment of the present invention.

As illustrated in FIG. 11, the rear-surface electrode rollers 53*a*, 53*b*, 53*c* are disposed at respective positions on the rear surface of the intermediate transfer belt 23 between the back-up roller 22 and the driven roller 21, respectively kept in sliding contact with the rear surface of the intermediate transfer belt 23. The positions where the rear-surface electrode rollers 53*a*, 53*b*, 53*c* are disposed, are respectively $L_1$, $L_2$, $L_3$ in length away from a contact point A of the back-up roller 22 and the transfer roller 25 toward the driven roller 21. Further, the rear-surface electrode rollers 53*a*, 53*b*, 53*c* are made up of, for example, stainless steel with a diameter of substantial 8 mm and a length covering a total width of the intermediate transfer belt 23, and arranged so that one of them may be connected to ground according to each mode, namely, OHP mode, A3 mode, or A4 mode, specified in accordance with copy paper sheets 30 to be used, as will be classified in Table 2 later. Each of these modes is specified in accordance with the kind and size of the copy paper sheets 30, and has a different travel speed of the intermediate transfer belt 23, that is, a different process speed thereof. In the present embodiment, the process speeds of the OHP mode, A3 mode and A4 mode are set to 60 mm/s, 115 mm/s and 184 mm/s respectively.

Figure 12:
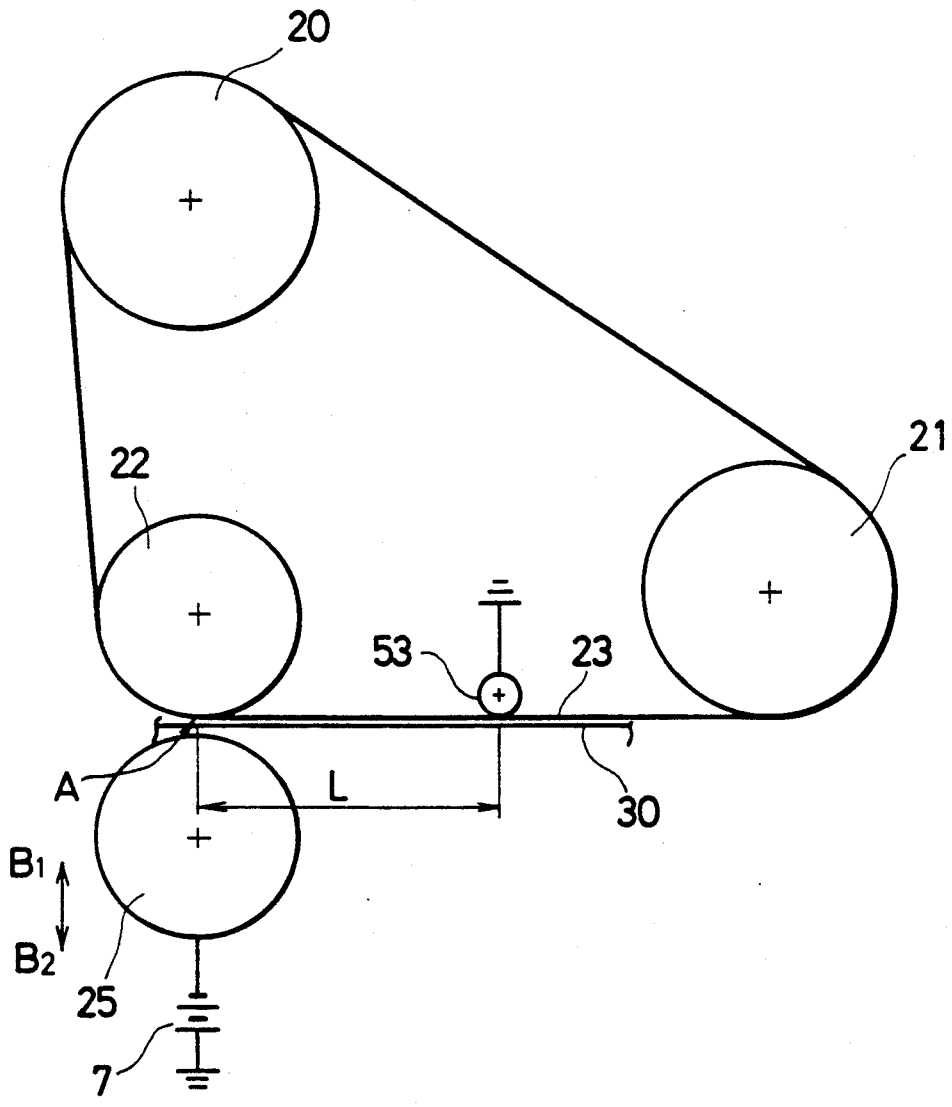

As illustrated in FIG. 12, transfer operation of a full color toner image from the intermediate transfer belt 23 onto the copy paper sheet 30 is performed, under a condition where a specified one of the rear-surface electrode rollers 53*a*, 53*b*, 53*c* (hereinafter referred to as the rear-surface electrode roller 53) is connected to ground in accordance with a specified mode of the OHP mode, A3 mode and A4 mode, and a transfer voltage from the power supply 7 is applied between the transfer roller 25 and the rear-surface electrode roller 53 connected to ground.

In that case, a circuit between the transfer roller 25 and the rear-surface electrode roller 53, which involves a resistance $R_p$ of the copy paper sheet 30, a resistance $R_{TX}$ of the intermediate transfer belt 23 having a length L from the contact point A of the back-up roller 22 and the transfer roller 25 to the rear-surface electrode roller 53, and a transfer voltage supplied from the power supply 7, is shown by FIG. 9 (*a*) which was aforementioned in the first embodiment.

Here, the relation between the resistance $R_{TX}$ and the length L is expressed by:

$$R_{TX}=k\cdot L \text{ (k:constant).}$$

Accordingly, resistances $R_{TX}$s of the intermediate transfer belt 23 in OHP mode, A3 mode, and A4 mode are respectively expressed by:

$$R_{TX}(OHP)=k\cdot L_1,$$

$$R_{TX}(A3)=k\cdot L_2, \text{ and}$$

$$R_{TX}(A4)=k\cdot L_3.$$

Further, with a constant transfer voltage, in order to make power consumption per hour in each mode identical to one another, the relation between a process speed (hereinafter referred to as P.S) and a resistance $R_{TX}$ is given by:

$$k\cdot L/60=k\cdot L_2/115=k\cdot L_3/184.$$

When appropriate values of L are set based on the above equation, the following substantial set values are obtained, as also shown in Table 2:

$$L_1=10 \text{ mm}, L_2=20 \text{ mm}, \text{ and } L_3=30 \text{ mm}.$$

Thus, desirable transfer operation can be achieved by setting a constant and appropriate transfer voltage for every mode, based on these set values.

TABLE 2

| Mode | P · S [mm/s] | Roller Grounded | Length [mm] |
|---|---|---|---|
| OHP | 60 | 53a | $L_1$ = 10 |
| A3 | 115 | 53b | $L_2$ = 20 |
| A4 | 184 | 53c | $L_3$ = 30 |

Figure 13:
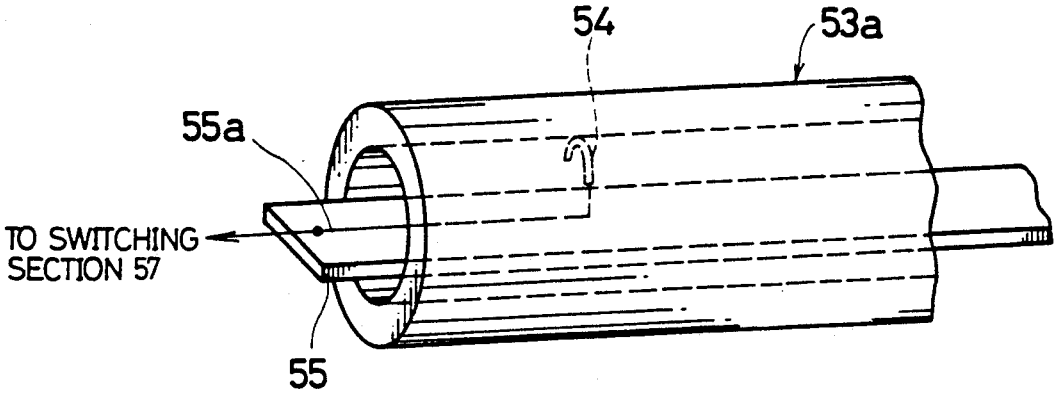

Taking the rear-surface electrode roller 53*a* as an example, FIG. 13 shows a structure for connecting one of the rear-surface electrode rollers 53*a*, 53*b*, 53*c* to ground depending on each mode. Inside the rear-surface electrode roller 53*a* is disposed a sliding conductor 54 in contact with the inner surface thereof. The sliding conductor 54 is connected to a wiring substrate 55 installed inside the rear-surface electrode roller 53*a*, and further the wiring substrate 55 is connected to a switching section 57 of a rear-surface electrode roller switching device 56 for connecting a wire 55*a* on the wiring substrate 55 to ground, which will be described later. The same structure as described above is applied to the other rear-surface electrode rollers 53*b*, 53*c*.

As illustrated in FIG. 5, at the paper feeding side with respect to the intermediate transfer device 19 of FIG. 15, are inserted one above the other the paper feed cassettes 26, 27 accommodating copy paper sheets 30, and above the paper feed cassette 26 is disposed the manual paper feed tray 40. In the present embodiment, paper feeding operation of copy paper sheets of A4 or A3 is available by the use of the paper feed cassette 26 or 27, whereas paper feeding operation of OHP sheets is available by the use cf the manual paper feed tray 40. Between the intermediate transfer device 19 and each of the paper cassettes 26, 27 as well as the manual paper feed tray 40 are disposed the paper feed rollers 28, 29, 41, the transport rollers 42, 43 and the timing roller 31. Between the manual paper feed tray 40 and the paper feed roller 41 is installed the manual paper feed detection switch 47, and between the transport roller 43 and the timing roller 31 is installed the OHP sensor 44

Figure 14:
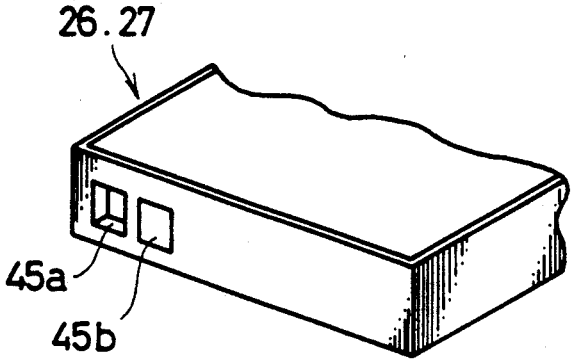

As illustrated in FIG. 14, on each front end surface of the paper cassettes 26, 27 to be inserted into the copying machine housing are disposed the paper size detection sections 45*a*, 45*b* for indicating the size of the copy paper sheets 30 accommodated in the paper cassettes 26, 27. As illustrated in FIG. 5, at areas in the copying machine housing, which have operative relationship with the paper size detection sections 45*a*, 45*b* are disposed the paper size detection switch sections 46, each having detection switches (not shown) which match respective paper size detection sections 45*a*, 45*b*. Accordingly, when the paper cassette 26 or 27 is inserted into the copying machine housing, a specified one of the paper size detection sections 45*a*, 45*b* of the paper cassette 26 or 27 is recessed, and the detection switch of the paper size detection switch section 46 matching the recessed section is turned on by the recessed section, thereby permitting the detection of the size of the copy paper sheets 30 accommodated in the paper cassette 26 or 27.

Figure 16:
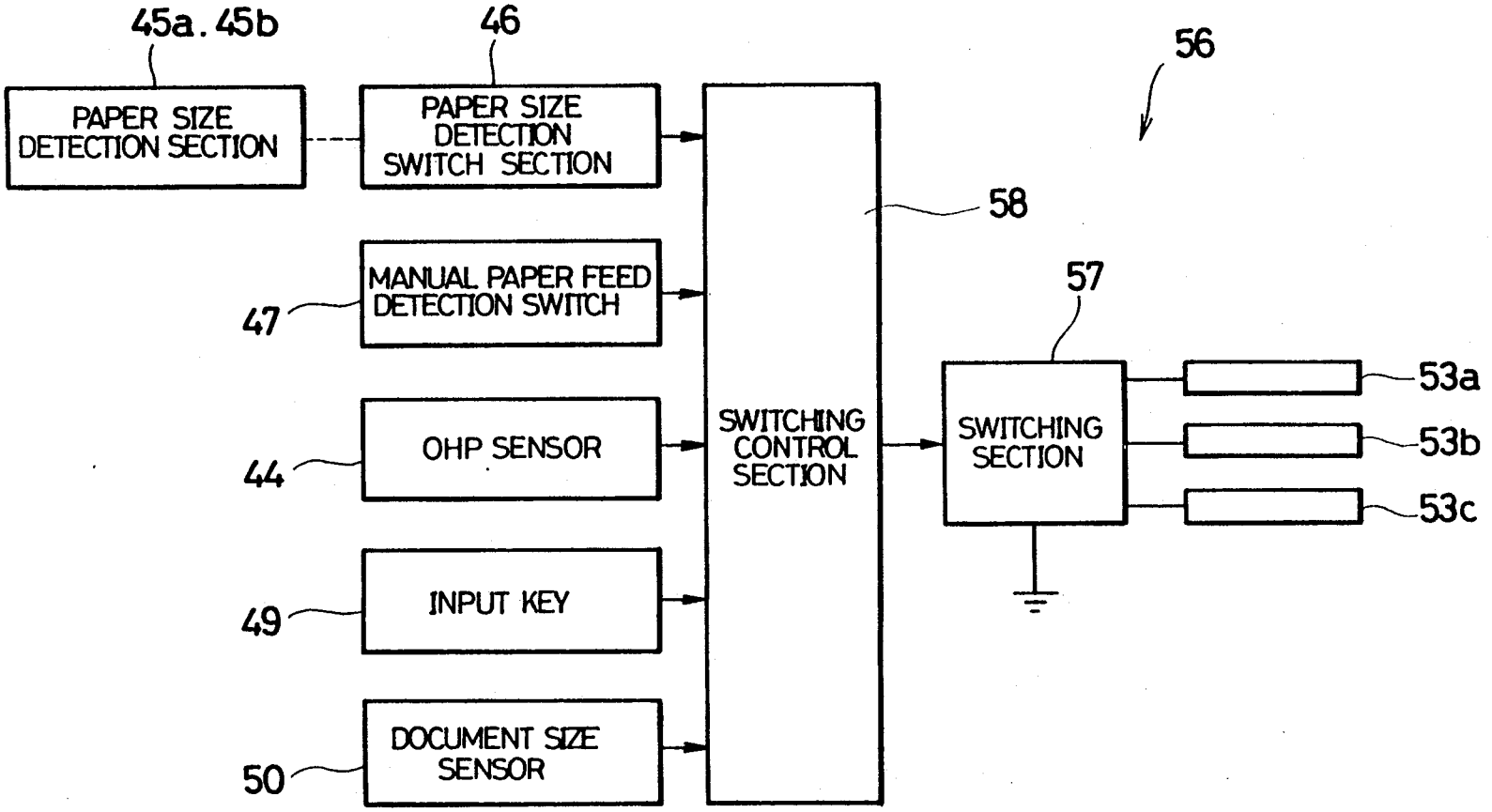
Figure 17:
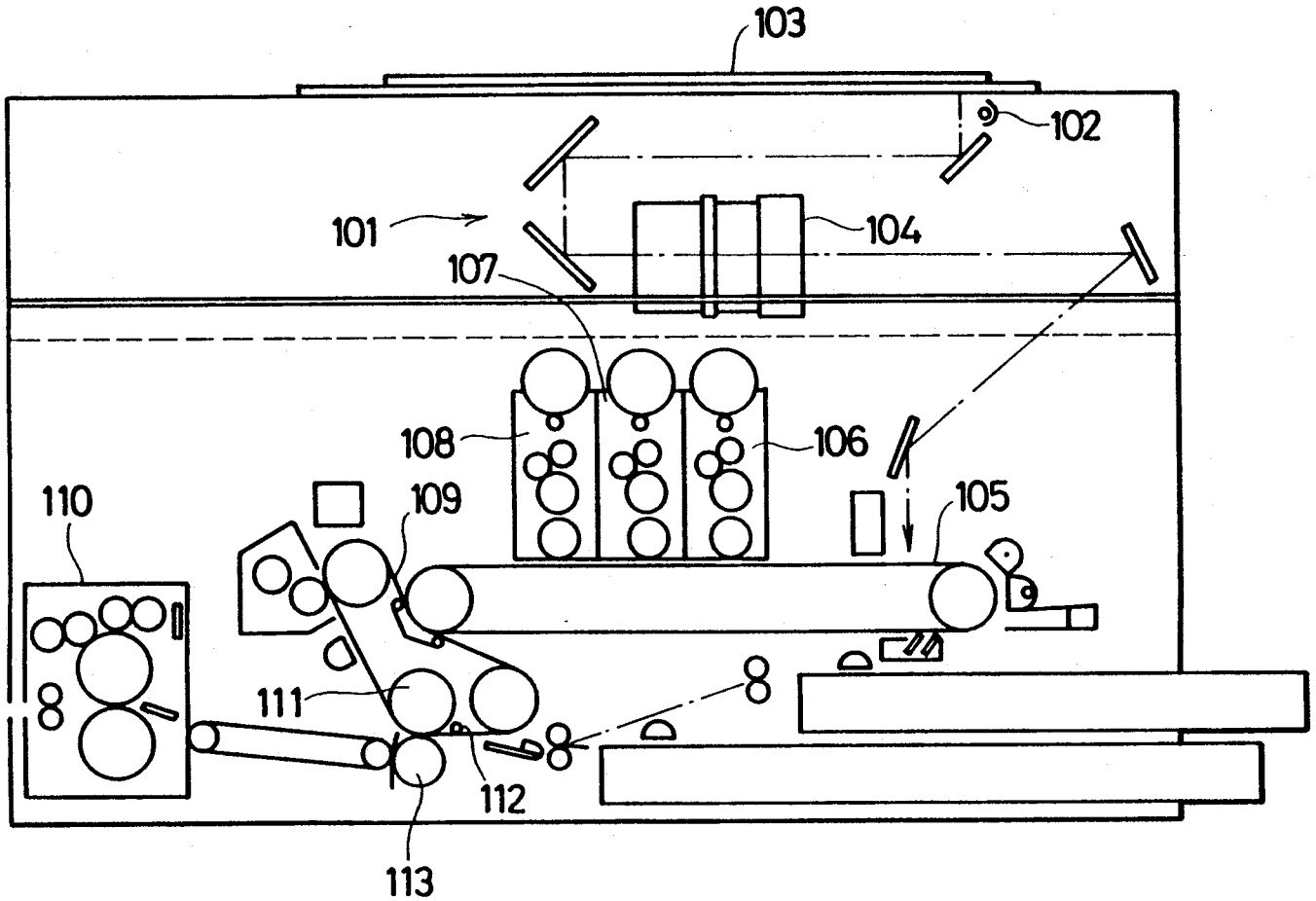
FIG. 17 PRIOR ART
FIGS. 17 to 19 show the prior art.
Figure 18:
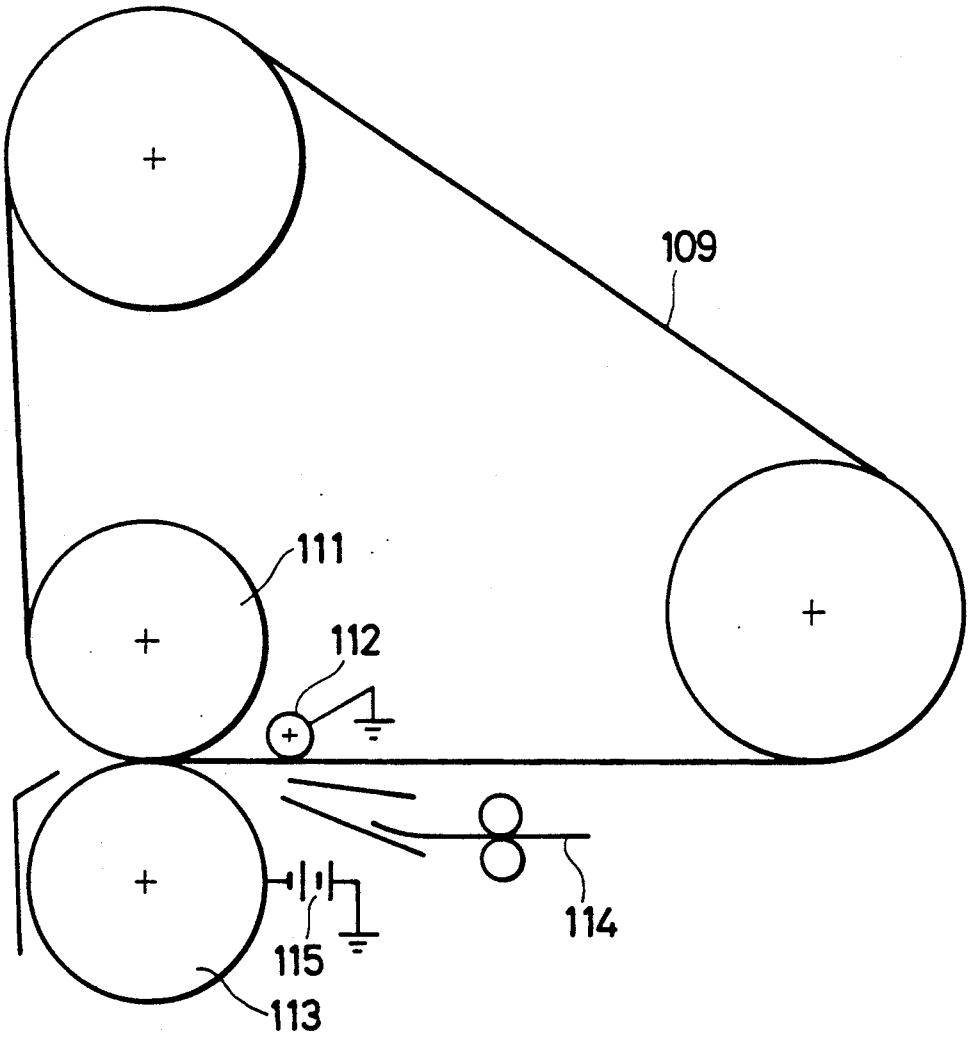
FIG. 18 PRIOR ART

Furthermore, the present transfer roller device is provided with a rear-surface electrode roller switching device 56 shown in FIG. 16. The rear-surface electrode roller switching device 56 includes the above-mentioned paper size detection sections 45*a*, 45*b*, the paper size detection switch sections 46, the manual paper feed detection switch 47 and the OHP sensor 44, and further includes the input key 49, the document size sensor 50, a switching control section 58 as switching control means having a microcomputer, and a switching section 57 as switching means for selectively connecting one of the rear-surface electrode rollers 53*a*, 53*b*, 53*c* to ground while being controlled by the switching control section 58. The switching section 57 may be constituted of known devices such as electric devices, for example, relays or the like having contact points, or electronic circuits using switching elements therein.

The switching control section 58 detects the kind and size of copy paper sheets 30 to be used based on inputs from the paper size detection sections 45*a*, 45*b*, paper size detection switch sections 46, manual paper feed detection switch 47, OHP sensor 44, input key 49, and document size sensor 50. In a copying machine of the present invention, an appropriate mode is selected among OHP mode, A3 mode and A4 mode, according to the results of the detection conducted by the switching control section 58. More specifically, the switching control section 58 controls the switching section 57 so that a corresponding one of the rear-surface electrode rollers 53*a*, 53*b*, 53*c* may be connected to ground according to a selected mode, as is shown in Table 2. The selection of the mode for which the above control operation is provided, is executed in accordance with the following order of preference: the OHP mode is selected when an OHP sheet is detected by an output of the OHP sensor 44 upon detecting a manual copy paper sheet supply by the manual paper feed detection switch 47 being switched on; when a copy paper sheet 30 accommodated in the paper cassette 26 or 27 is specified by the input key 49, the mode appropriate to the copy paper sheet 30 is selected; when it is detected that a copy paper sheet having a size corresponding to an original document size is accommodated either in the paper sheet cassette 26 or 27 based on an output of the document size sensor 50 and an output of the paper size detection switch section 46, the mode appropriate to the copy paper sheet 30 is selected.

A full color toner image formed on the intermediate transfer belt 23 through the same processes as described in the aforementioned embodiment, is transferred onto a copy paper sheet 30 by the transfer roller device in the following manner.

The transfer operation is performed by connecting to ground the rear-surface electrode roller 53 which corresponds to the selected mode among the OHP mode, A3 mode and A4 mode, as shown in Table 2, and then applying a transfer voltage from the power supply 7 between the transfer roller 25 and the rear-surface electrode roller 53, under conditions as illustrated in FIG. 12, where the copy paper sheet 30 is depressed onto the intermediate transfer belt 23 at a contact point A by the back-up roller 22 and the transfer roller 25 which has been driven and advanced in a direction of an arrow $B_1$. Grounding of the rear-surface electrode roller 53 is automatically performed by the switching control section 58 which controls the switching operation of the switching section 57 based on the inputs from the paper size detection switch section 46, manual paper feed detection switch 47, OHP sensor 44, input key 49 and document size sensor 50, as was described above. With the above arrangement, a distance from the transfer roller 25 to the selected one of the rear-surface electrode rollers 53*a*, 53*b*, 53*c* can be appropriately set depending on each mode having a different processing speed. Thus, identical power consumption is set in each mode even if the same transfer voltage is applied, thereby providing a desirable transfer operation.

The invention being thus described, it may be obvious that the same may be varies in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A transfer roller device comprising:

a belt-like image forming medium having a front surface and a rear surface;

a transfer roller disposed at the front-surface side of the belt-like image forming medium;

a back-up roller disposed at the rear-surface side of the belt-like image forming medium, confronting the transfer roller; and a rear-surface electrode roller disposed at the rear-surface side of the belt-like image forming medium in sliding contact with the belt-like image forming medium, being spaced at a predetermined interval to the back-up roller, wherein a copy paper sheet fed between the transfer roller and the image forming medium is depressed onto the image forming medium by the transfer roller and the back-up roller while applying a transfer voltage between the rear-surface electrode roller and the transfer roller such that an image formed by developers on the front surface of the image forming medium is transferred onto the copy paper sheet, the rear-surface electrode roller comprising:

a reference position; and a plurality of cylinder members which are made by dividing the rear-surface electrode roller at positions, each of the positions corresponding to a length from a transport reference position of a copy paper sheet of each size in a direction perpendicular to a transport direction, while keeping coincidence between the reference position of the rear-surface electrode roller and the transport reference position of the copy paper sheet, whereby, the copy paper sheet is transported with the transport reference position coinciding with the reference position of the rear-surface electrode roller, and at least one of the cylinder members forming a portion corresponding to a length of the copy paper sheet in a direction perpendicular to the transport direction is connected to ground.

2. The transfer roller device as set forth in claim 1, wherein the image forming medium is an intermediate transfer belt whereon toner images formed on a photoconductor belt is transferred to form an image with developers.

3. The transfer roller device as set forth in claim 1, the rear-surface electrode roller comprises:

sliding conductors, each disposed so as to contact with an inner surface of the respective cylinder member; and wires disposed on a wiring substrate installed inside the rear-surface electrode roller, which are connected to the respective sliding conductors, and further connected to switching means.

4. The transfer roller device as set forth in claim 1, further comprising:

paper size detection means for detecting a size of a copy paper sheet to be used;

switching means for selectively connecting at least one of the cylinder members to ground; and switching control means for controlling switching operations of the switching means so as to connect to ground at least one of the cylinder members forming a portion corresponding to a length of the copy paper sheet in a direction perpendicular to the transport direction, upon the copy paper sheet being detected by the paper size detection means.

5. The transfer roller device as set forth in claim 4, wherein the paper size detection means comprises:

paper size detection sections for indicating a size of copy paper sheets accommodated in a paper cassette;

paper size detection switch sections for detecting the size of the copy paper sheets accommodated in the paper cassette, which individually match the respective paper size detection sections;

a manual paper feed detection switch for detecting a copy paper sheet manually fed;

an OHP sensor for detecting whether a copy paper sheet being transported is an OHP sheet or not;

an input key for selecting a paper cassette to be used; and a document size sensor for detecting a size of an original document to be copied.

6. The transfer roller device as set forth in claim 4, wherein the switching control means is a switching control section comprised of a microcomputer, and the switching means is a switching section which, controlled by the switching control section, switches the cylinder members to be connected to ground.

7. A transfer roller device comprising:

a belt-like image forming medium having a front surface and a rear surface;

a transfer roller disposed at the front-surface side of the belt-like image forming medium;

a back-up roller disposed at the rear-surface side of the belt-like image forming medium, confronting the transfer roller; and a plurality of rear-surface electrode rollers disposed at the rear-surface side of the belt-like image forming medium in sliding contact with the belt-like image forming medium, each of the rear-surface electrode rollers being spaced at a predetermined interval to the back-up roller, wherein a copy paper sheet fed between the transfer roller and the image forming medium is depressed onto the image forming medium by the transfer roller and the back-up roller while applying a transfer voltage between one of the rear-surface electrode rollers and the transfer roller such that an image formed by developers on the surface of the image forming medium is transferred onto the copy paper sheet, the transfer roller device including, a plurality of modes for providing respective different travel speeds of the image forming medium, corresponding to respective sizes of the copy paper sheets, the rear-surface electrode rollers being disposed as many in number as are the modes, each of the rear-surface electrode rollers being spaced at a respective distance to a contact point of the transfer roller and the back-up roller, the distance being associated with a respective travel speed of the image forming medium in each mode, one of the rear-surface electrode rollers corresponding to a specified mode being connected to ground.

8. The transfer roller device as set forth in claim 7, wherein the image forming medium is an intermediate transfer belt whereon toner images formed on a photoconductor belt is transferred to form an image with developers.

9. The transfer roller device as set forth in claim 7, the rear-surface electrode roller comprises:

a sliding conductor disposed so as to contact with an inner surface of the rear-surface electrode roller; and a wire disposed on a wiring substrate installed inside the rear-surface electrode roller, which is connected to the sliding conductor, and further connected to switching means.

10. The transfer roller device as set forth in claim 7, further comprising:

switching means for selectively connecting at least one of the rear-surface electrode rollers to ground; and switching control means for controlling switching operations of the switching means so as to connect to ground one of the rear-surface electrode rollers corresponding to a specified mode.

11. The transfer roller device as set forth in claim 10, wherein the switching control means is a switching control section for detecting a kind and a size of a copy paper sheet to be used and setting a mode based on results of the detection.

12. The transfer roller device as set forth in claim 11, wherein the switching means is a switching section which, controlled by the switching control section, switches the rear-surface electrode rollers from one to another so as to be connected to ground according to a specified mode.

* * * * *